United States Patent [19]

Ichikawa

[11] Patent Number: 4,597,316

[45] Date of Patent: Jul. 1, 1986

[54] APPARATUS FOR UNWINDING WEB ROLL

[75] Inventor: Haruo Ichikawa, Minami-ashigara, Japan

[73] Assignee: Fuji Photo Film Co., Ltd., Kanagawa, Japan

[21] Appl. No.: 661,529

[22] Filed: Oct. 16, 1984

[30] Foreign Application Priority Data

Oct. 19, 1983 [JP] Japan ..... 58-195482

[51] Int. Cl.[4] ..... B65H 19/22; B26D 7/00

[52] U.S. Cl. ..... 83/156; 83/425.3; 83/650; 242/58; 242/64

[58] Field of Search ..... 83/149, 151, 156, 734, 83/425.3, 453, 454, 456, 648-650; 242/58, 64, 56; 53/212

[56] References Cited

U.S. PATENT DOCUMENTS

| | | | |
|---|---|---|---|
| 3,134,554 | 5/1964 | Dexter | 242/58 X |
| 3,821,917 | 7/1974 | Hatanaka | 83/650 X |
| 4,171,780 | 10/1979 | Bugnone | 242/56 A |

FOREIGN PATENT DOCUMENTS 53-51371 5/1978 Japan .

*Primary Examiner*—E. R. Kazenske
*Assistant Examiner*—John L. Knoble
*Attorney, Agent, or Firm*—Sughrue, Mion, Zinn, Macpeak, and Seas

[57] ABSTRACT

An apparatus for unwinding a roll of a thin belt-like discrete sheet material (hereinafter referred to as a "web") including paper, plastic film, fabric, metal and the like includes a cutter mechanism for cutting the forward end portion of the web of the web roll with the core and the forward end portion of the web being previously fixed in the winding direction, a nip mechanism for clamping the forward end portion of the web after the web is cut, and an unwinding shaft to be coupled to the core of the web roll, the cutter mechanism and the nip mechanism together with the unwinding shaft being linearly movable to and from a web roll storing position. The unwinding shaft position is movable, while the web roll supply position is stationary, so that the space for installing the apparatus can be minimized. Furthermore, the apparatus has a nip mechanism for clamping the forward end of the web, whereby the web roll can be delivered in a state where the forward end of the web is clamped.

7 Claims, 11 Drawing Figures

APPARATUS FOR UNWINDING WEB ROLL

BACKGROUND OF THE INVENTION

1. Field of the Invention

This invention relates to an apparatus for unwinding a web roll, and particularly to an apparatus for unwinding a roll of a thin belt-like discrete sheet material (hereinafter referred to as a "web") including paper, plastic film, fabric, metal and the like.

2. Description of the Prior Art

In a known apparatus for unwinding a web roll, the web roll is supplied from the storing section to an unwinding section, a core of the web roll is secured to an unwinding shaft, and a tensile force in the unwinding direction is applied to the forward end portion of the web to unwind the web. When the web roll was not supplied from the storing section to the unwinding section under conditions where the tensile force was applied to the forward end of the web, forming failures would be caused. The above-described problem has heretofore made it difficult to automate the mounting operation of the web roll.

There has been proposed a device for automatically supplying a web roll as disclosed in Japanese Kokai No. 51371/78, in which, however, an arrangement has been adopted such that the unwinding shaft position is fixed and the web roll supply position is movable, thus presenting disadvantages in that the mechanism is complicated and the space required for installation is increased.

SUMMARY OF THE INVENTION

The present invention has been developed to obviate the above-described disadvantages of the prior art and has as its object the provision of an apparatus for unwinding a web roll, wherein the web roll is automatically supplied and the web can be unwound through the use of a simplified construction.

For this purpose, the present invention comprises; a cutter mechanism for cutting the forward end portion of the web roll, whose core and forward end portion have been previously fixed in the winding direction; a nip mechanism for clamping the forward end portion of the web roll after cutting; and an unwinding shaft having a core chuck mechanism linearly movable in the axial direction; the cutter mechanism and nip mechanism together with the unwinding shaft being linearly movable to and from a web roll storing section.

BRIEF DESCRIPTION OF THE DRAWINGS

Other objects and advantages of the invention will be readily apparent from consideration of the following specification and accompanying drawings, in which like reference characters designate the same or similar parts throughout the figures thereof and wherein.

DETAILED DESCRIPTION OF THE PREFERRED EMBODIMENTS

The invention will now be described by way of example with reference to the accompanying drawings.

Figure 1:
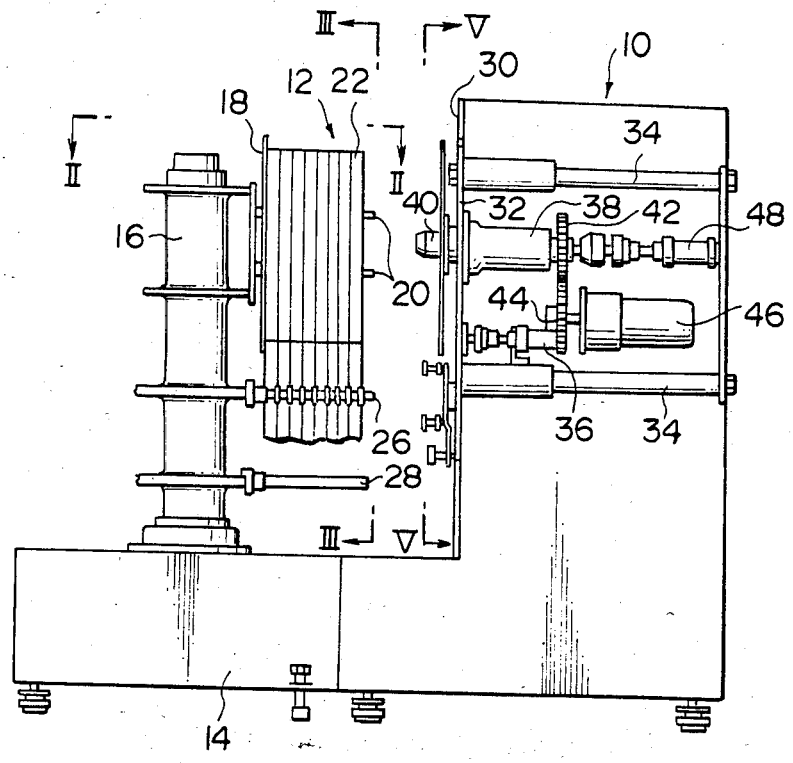
FIG. 1 is a front view showing the general construction of the apparatus for unwinding a web roll according to the present invention.
Figure 2:
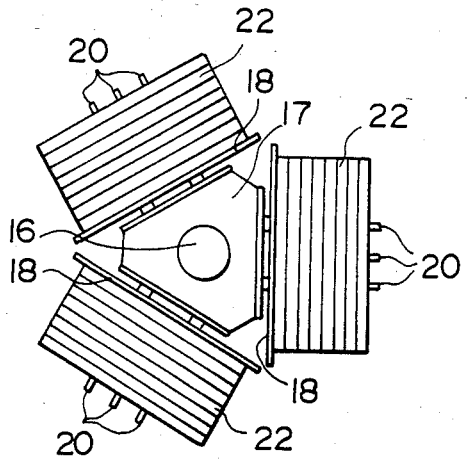
FIG. 2 is a plan view of the web roll storing section taken in the direction indicated by the arrows II—II in FIG. 1.
Figure 3:
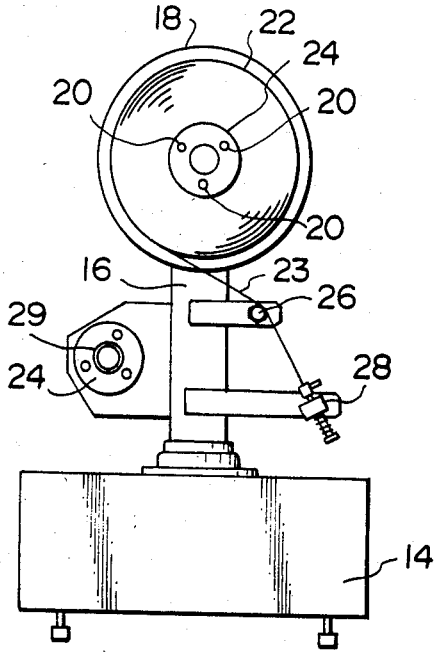
FIG. 3 is a side view of the web roll storing section taken in the direction indicated by the arrows III—III in FIG. 1.

Referring to FIG. 1, designated at 10 is a web roll unwinding section and at 12, a web roll storing section. Description will now be given of the web roll storing section 12. A rotary post 16 is uprightly supported by a platform 14 and is intermittently driven by a motor, not shown, in the platform 14. As shown in FIG. 2, the post 16 is provided with support plates 18 directed in three directions (Only one direction is indicated in FIG. 1). Each support plate 18 is provided with three support shafts 20 projecting in the horizontal direction (Only two support shafts are shown in FIG. 1). As shown in FIG. 3, a core 24 of the web roll 22 is secured to these support shafts 20. Furthermore, as shown in FIG. 3, a web setting shaft 26 is provided downwardly of the support plate 18, and a clamp mechanism 28 is provided further downwardly of the support plate 18. The clamp mechanisms 28 correspond in number to the web rolls 22. Each clamp mechanism 28 clamps the forward end of the web 23 with tension so as to prevent forming failure at the web roll 22. Furthermore, the post 16 is provided with a core accumulating bar 29 for accumulating cores 24 of the web roll upon the completion of unwinding.

As shown in FIG. 1, a side plate 30 integrally formed on the platform 14 is provided with a movable plate 32, which is separate from the side plate 30. The movable plate 32 can move under the guidance of guide bars 34 toward the web roll storing section 12, i.e. to the left in FIG. 1. The movable plate 32 is secured to a working rod of a cylinder 36 supported by the platform 14, whereby the cylinder 36 may be operated to move the movable plate 32 to the right and left. The movable plate 32 is provided with an unwinding shaft 38. The core 24 of the web roll 22 can be installed on the left end portion 40 of this unwind shaft 38. The unwinding shaft 38 is provided thereon with a gear 42 which is in mesh with a gear 44 in the lower stage, and a shaft of this gear 44 is connected to an output shaft of a motor 46, which is provided on the main body of an apparatus for imparting a predetermined tension to the web roll 22 when the web roll 22 is unwound.

Figure 4:
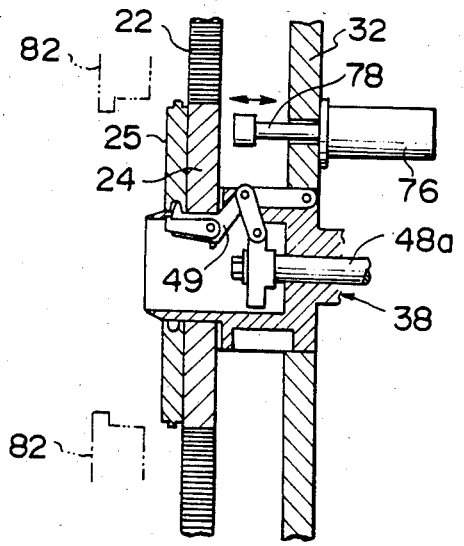
FIG. 4 is a sectional view showing the chuck mechanism of the unwinding shaft.

A member indicated by reference numeral 48 is a cylinder for operating a chuck mechanism shown in FIG. 4. The cylinder 48 operates the working rod 48*a* thereof to expand or retract a chuck pawl 49, so that the core 24 of the web roll 22 may be chucked or unchucked.

Figure 5:
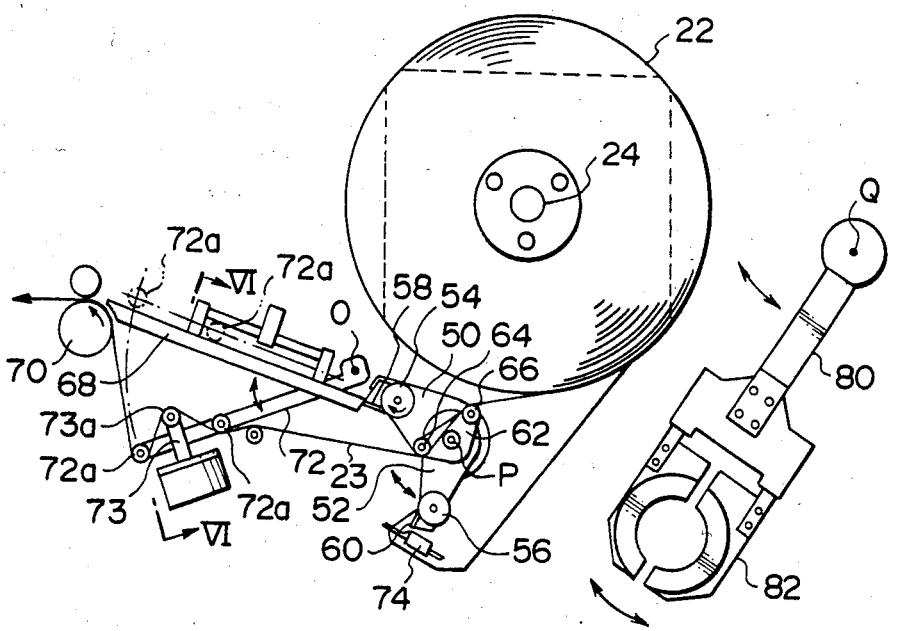
FIG. 5 is a side view of the mechanism for delivering the web roll taken in the direction indicated by the arrows V—V in FIG. 1.

Description will hereunder be given of a nip mechanism for the web roll. Firstly, a pair of arms 50 and 52 as shown in FIG. 5 are pivotally supported on the movable plate 32. Arm 50 is provided with an insert roller 54, while the other arm 52 is provided with a nip roller 56. Guides 58 and 60 are provided on the forward end portions of the arms 50 and 52, respectively. Further, a tensioner 62 is provided concentrically with the rotary center of the arms 50 and 52. Rollers 64 and 66 are provided on opposite ends of this tensioner 62. The arms 50, 52 and the tensioner 62 can be rotated about a point P within a predetermined range by a cylinder mechanism, not shown.

Figure 6:
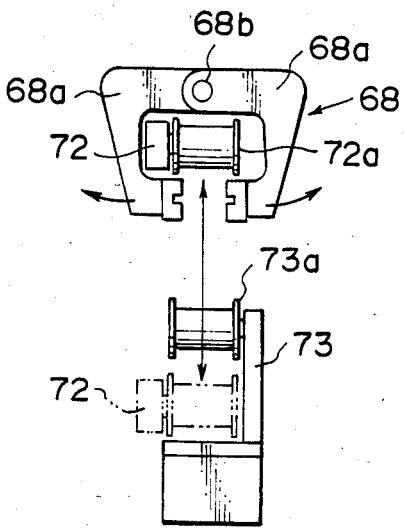
FIG. 6 is a sectional view taken in the direction indicated by the arrows VI—VI in FIG. 5.
Figure 7A:
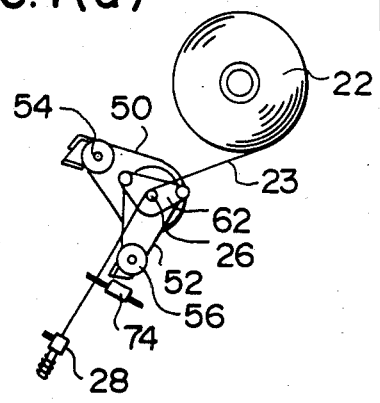
FIGS. 7(*a*)-(*e*) is an explanatory view showing the arms and the tensioner in actuated positions.
Figure 7B:
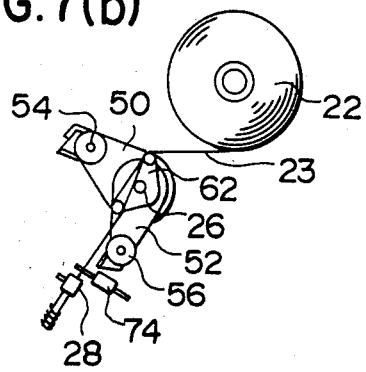
Figure 7C:
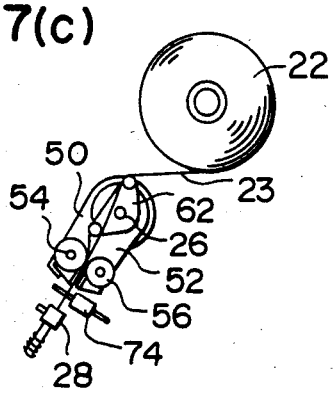
Figure 7D:
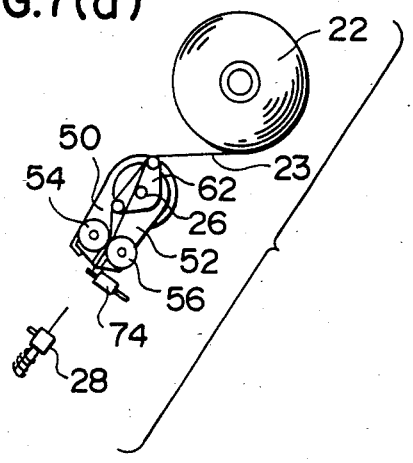
Figure 7E:
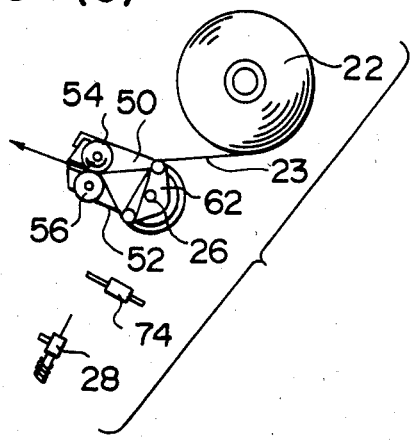

A web guide 68 for conducting the passage of the web 23 in the initial stage of unwinding as shown in FIG. 5 is disposed at an outlet portion for the web 23, which is formed by the abutting of the nip roller 56 against the insert roller 54 of the arm 50 due to the rotation of the arm 52 in the clockwise direction. A main feed roller 70 is disposed at an outlet of the web guide 68. As shown in FIG. 6, the web guide 68 is formed by a pair of substantially C-shaped members 68*a* and 68*b*, which rock about a shaft 68*b*. Further, a tension arm 72 is capable of rocking about a point O. The tension arm 72 has a plurality of rollers 72*a*, and moves upwardly to be positioned in the web guide 68 as indicated by a solid line in FIG. 6, guides the forward end portion of the web therearound, and, upon guiding the same therearound, moves downwardly to a position indicated by chain lines in FIG. 6 in such a manner that the web comes into abutting contact with a roller 73*a* of a tension pickup 73. The tension pickup 73 measures the tension so as to control the same to a predetermined value. Furthermore, a cutter 74 is disposed downwardly of the forward end of the arm 52 as shown in FIG. 5. The cutter 74 is moved in a direction perpendicular to the paper by a cylinder, not shown, to cut the web.

Subsequently, description will be given of a mechanism for discharging the core upon completion of unwinding of the web. As shown in FIG. 5, a core discharge arm 80 can rock about a point Q, and a core catch 82 capable of opening and closing for gripping the core 24 is provided on the forward end portion of the core discharge arm 80. When the core discharge arm 80 rocks about the point Q upwardly, the core catch 82 is adapted to come to a position opposed to the core 24.

A cylinder 76 shown in FIG. 4 is operated at this position, whereby the core 24 is discharged into the core catch 82 by a push rod 78.

The operation of the embodiment having the above-described arrangement according to the present invention will be described below.

Firstly, an operator sets a plurality of web roll 22 into the web roll storing section 12. The forward ends of the webs of the web rolls 22 are guided around the web setting shaft 26, and the forward ends of the webs are clamped by clamp mechanisms 28. Now, when the unwinding shaft 38 has no web roll core thereon, the web guide 68 shown in FIG. 6 opens in response to an auto-loading start signal, the tension arm 72 rocks upwardly from a position indicated by solid lines in FIG. 5 (the position indicated by chain lines in FIG. 6) and enters the web guide 68 as indicated by the solid line in FIG. 6. Then, the tensioner 62 rotates in the clockwise direction as shown in FIG. 7(*a*).

Subsequently, the cylinder 36 is operated to cause the movable plate 32 to proceed toward the web roll 22. The unwinding shaft 38 is coupled into a hole of the core 24 and chucks the same. Subsequently, the tensioner 62 rotates in the counterclockwise direction to be positioned as shown in FIG. 7(*b*), and removes the web 23 from a groove in the web set shaft 26. The arm 50 rotates in the counterclockwise direction, whereby the forward end portion of the web 23 is clamped between the insert roller 54 and the nip roller 56 as shown in FIG. 7(*c*). Thereupon, the cutter 74 moves to cut the forward end portion of the web as shown in FIG. 7(*d*). Subsequently, the movable plate 32 is retracted through the action of the cylinder 36, thus conducting the delivery of the web.

Subsequently, the arms 50 and 52 rotate in the clockwise direction, clamping the web as shown in FIG. 7(*e*). Thereafter, the web guide 68 closes. The forward end of the web is fed by the insert roller 54, the web 23 is threaded through the web guide 68 and delivered to the main feed roller 70. Then, the web guide 68 opens, the arm 52 rocks downwardly and the web in the guide section becomes free. Subsequently, the tension arm 72 rocks downwardly, and the web 23 comes into abutting contact with the tension pickup 73, thus finishing the threading of the web. With the above-described process, the takeup operation of the web slit is completed, and then, the unwinding operation is carried out. Upon completion of unwinding, only the core 24 is left on the unwinding shaft 38. In this case, the tail end of the web is detected, and, upon discharging the tail end, an auto-loading start signal is emitted. The core discharge arm 80 rocks upwardly, and the core catch 82 is set at a position in front of the unwinding shaft 38. The unwinding shaft 38, unchucking the core 24, proceeds to the core catch 82, the core 24 is pushed out by the push rod 78 and taken up by the core catch 82. The core discharge arm 80, gripping the core 24, descends. The core 24 in the core catch 82 is pushed out by a core pusher, not shown, at the lower limit of the descent of the core discharge arm 80 and stored on the core accumulating bar 29 of the web roll storing section 12. At the same time as the core discharge arm 80 descends to its lower limit, the subsequent web roll takeup action is started, and thus the above-described operations are repeated.

It is desirable that, in the above embodiment, when the web roll is installed on the support shafts 20 of the web roll storing section 12, a spacer 25 is provided as shown in FIG. 4, so that the slits can be prevented from being entangled with each other and a poorly wound slit in an irregular shape can be unwound without hindrance. The spacer 25 may be formed separately of the core 24 or integrally with the core 24. As shown in FIG. 4, the core 24 and the spacer 25 may be clamped and discharged at the same time.

As has been described hereinabove, in the apparatus for unwinding the web roll according to the present invention, comprising the cutter mechanism for cutting the forward end portion of the web roll and the nip mechanism for clamping the forward end portion of the web roll, wherein the web roll is delivered with the forward end portion of the web in the clamped state, the forming failure never occurs. Moreover, the unwinding shaft is movable, while the web roll supplying side is stationary, so that the space required for installation can be saved.

Moreover, in the apparatus of the present invention, the web roll storage is of a turret type, whereby a multitude of web rolls can be set, such that web rolls can be automatically supplied for a long period of time.

What is claimed is:

1. An apparatus for unwinding a web roll, comprising; web roll storage means for storing a plurality of web rolls, a web delivery location whereat said web rolls are unwound, an unwinding shaft linearly movable between said web roll storage means and said web delivery location for delivering a web roll to said web roll delivery location, cutter means for cutting a forward end portion of a web on a web roll, nip means for clamping a forward end portion of said web after said web has been cut, said cutter means and said nip means being linearly movable together with said unwinding shaft, said unwinding shaft being selectively engagable with a core of said web roll.

2. An apparatus for unwinding a web roll as set forth in claim 1, wherein said unwinding shaft, said cutter means and said nip means are secured to a movable plate, said cutter means, said nip means and said unwinding shaft being linearly movable toward and away from said web roll storing means together with said movable plate.

3. An apparatus for unwinding a web roll as set forth in claim 2, wherein said nip means comprises:

a pair of arms connected to each other in a manner so as to be movable toward or away from one another; and a roller pivotally supported on a forward end of each arm.

4. An apparatus for unwinding a web roll as set forth in claim 3, further comprising tension means provided coaxially with said arms of said nip means, said tension means being provided on opposite ends thereof with rollers, and being rotatable so as to remove a web from a web setting shaft.

5. An apparatus for unwinding a web roll as set forth in claim 2, wherein said unwinding shaft is provided with a chuck mechanism for gripping the core of the web roll.

6. An apparatus for unwinding a web roll, comprising; web roll storage means for storing a plurality of web rolls, a web delivery location whereat said web rolls are unwound, a cutter mechanism for cutting the forward end portion of a web on a web roll, a nip mechanism for clamping a forward end portion of the web after said web has been cut, and an unwinding shaft engagable with a core of said web roll, said cutter mechanism and said nip mechanism together with said unwinding shaft being linearly movable toward and away from said web roll storage means, for delivering a web roll to said web delivery location, said web roll storage means including an upright rotary shaft, a plurality of support shafts directed radially outwardly from said rotary shaft in a horizontal direction at regular radial intervals, for supporting a plurality of aligned web rolls, and a clamp mechanism provided for each of the web rolls supported by said support shafts, for clamping forward end portions of said webs.

7. An apparatus for unwinding a web roll as set forth in claim 6, wherein said core of the web roll is integrally provided with a spacer.

* * * * *